US008183952B2

(12) United States Patent
Bunce et al.

(10) Patent No.: US 8,183,952 B2
(45) Date of Patent: May 22, 2012

(54) SURFACE MOUNTABLE CIRCULATOR

(75) Inventors: Graeme Bunce, Chittanango, NY (US); Thomas Lingel, Fayetteville, NY (US)

(73) Assignee: Anaren, Inc., East Syracuse, NY (US)

( * ) Notice: Subject to any disclaimer, the term of this patent is extended or adjusted under 35 U.S.C. 154(b) by 223 days.

(21) Appl. No.: 12/759,891

(22) Filed: Apr. 14, 2010

(65) Prior Publication Data

US 2010/0259336 A1 Oct. 14, 2010

Related U.S. Application Data

(60) Provisional application No. 61/168,977, filed on Apr. 14, 2009.

(51) Int. Cl.
*H01P 1/32* (2006.01)

(52) U.S. Cl. ..... 333/1.1; 333/24.2

(58) Field of Classification Search ..... 333/1.1, 333/24.2

See application file for complete search history.

(56) References Cited

U.S. PATENT DOCUMENTS 3,573,666 A * 4/1971 Caffrey et al. ..... 333/1.1
3,854,106 A * 12/1974 Tresselt ..... 333/1.1
4,276,522 A * 6/1981 Coerver ..... 333/1.1
6,011,449 A 1/2000 Jussaume et al.
6,433,649 B2 8/2002 Miura et al.
6,844,789 B2 1/2005 Lombardi et al.
6,917,250 B2 7/2005 Lombardi et al.
2005/0040908 A1 * 2/2005 Mazzochette et al. ..... 333/1.1
2006/0139118 A1 6/2006 Vaughn et al.

* cited by examiner

*Primary Examiner* — Stephen Jones
(74) *Attorney, Agent, or Firm* — Daniel P. Malley; Bond Schoeneck & King

(57) ABSTRACT

The present invention is directed to a surface mountable circulator/isolator device that includes a first dielectric layer having an electric circuit formed thereon. A second center dielectric layer is disposed adjacent the first dielectric layer, the center dielectric layer including an opening formed therein, the opening being aligned relative to the electric circuit. A ferrite element is disposed in the opening such that the ferrite abuts the electric circuit and is aligned in two-dimensions relative to the electric circuit. A third dielectric layer is disposed adjacent the second center layer. The third dielectric layer includes a ground plane formed on each major surface thereof. The first dielectric layer, the second center dielectric layer, the ferrite element, and the third dielectric layer are bonded together to form a laminated multi-layer structure. A permanent magnet is bonded to the second ground plane.

38 Claims, 3 Drawing Sheets

SURFACE MOUNTABLE CIRCULATOR

CROSS-REFERENCE TO RELATED APPLICATIONS

This application claims priority under 35 U.S.C. §119(e) to U.S. Provisional Patent Application Ser. No. 61/168,977 filed on Apr. 14, 2009, the content of which is relied upon and incorporated herein by reference in its entirety.

BACKGROUND OF THE INVENTION

1. Field of the Invention

The present invention relates generally to RF components, and particularly to RF components such as circulators and isolators.

2. Technical Background

Circulators and isolators are passive multi-port microwave device that are typically used in RF transmission line applications. A typical ferrite circulator includes three ports, and is generally referred to as a Y-junction circulator. In operation, when an RF signal is directed into a first port, the RF signal will be accessible via the second port in sequence, i.e., the port immediately adjacent the input port. The RF signal will be substantially attenuated and will not be available at the third port in the sequence, i.e., the port immediately adjacent to the second port on the other side of the first input port. On the other hand, if an RF signal is directed into the second port, it will be available as an RF output signal at the third port, but will not be available at the first port. Finally, if an RF signal is introduced at the third port, it will be available as an RF output at the first port, but not at the second port. A circulator, therefore, propagates RF power from one adjacent port to the next in a sequential, circular fashion. The RF signal circulation may be right-handed (RH) or left-handed (LH).

The circulation action in circulators/isolators is achieved by utilizing the "gyromagnetic effect" that is characteristic of ferrite materials. Ferrite materials have, in particular, specific magnetic properties which are mainly caused by spinning electrons. The spinning electrons have a magnetic moment and a mechanical moment. With the exposure of the ferrite material to an external magnetic field the magnetic moments can be aligned in parallel to the applied field. If all magnetic moments are aligned, the material is saturated. If another disturbing force, like an RF electromagnetic field, is applied to bring the electron spin out of alignment, a torque will act on the electron spin. The electron will then precess around the axis of the applied field with an angular frequency proportional to the applied field. The behavior of the material can be described mathematically using the Polder permeability tensor. The elements of the tensor are controlled by the RF frequency, the saturation magnetization of the material and the strength of the applied DC magnetic field. If the RF frequency is the same as the precession frequency, the ferrite material is operated at ferromagnetic resonance which also causes dissipation. Circulators and Isolators are generally operated with the magnetic biasing field adjusted to operate above or below ferromagnetic resonance.

When an RF signal is directed into the input port of the circulator, circulating phase shifted versions of the RF signal are induced within the ferrite discs. The degree of phase shift between counter circulating fields is a function of the strength of the DC magnetic field and diameter of the ferrite material. The circulator operates in accordance with the principles of superposition and constructive/destructive interference of counter-rotating RF waves. Using the example from above, when an RF signal is directed into the first port, the counter circulating RF signals are substantially in phase with each other at the second port, and therefore, they constructively interfere and reinforce each other. The amount of signal available at the second port is measured by what is commonly referred to as the insertion loss. In a properly functioning device the insertion loss is typically in the range of a few tenths of a decibel (dB). At the third port, the RF signals are out of phase with each other and substantially cancel each other. The term "substantially" refers to the fact that, in practice, the cancellation is not perfect and a residual signal may be detected. The amount of residual signal available at the third port, appropriately referred to as the "isolation," is measured by the ratio of the residual signal and the incident signal. The isolation is typically between −25 dB and −30 dB.

A circulator may be configured as an isolator by terminating one of the ports with a "matched load" such that the complex impedance of the load is the complex conjugate of the output port impedance. As noted above, an isolator permits RF signal propagation between the two remaining ports in one direction only. RF power flow in the opposite direction is substantially inhibited. Now that the general operating principles have been briefly touched upon, a similarly brief description of the structure of a junction circulator is provided.

A junction circulator may be configured to include both electrical and magnetic circuit components and may be implemented using a stripline, microstrip or waveguide transmission configuration. The circulator includes a circuit portion having a flat center conductor that has three branches extending symmetrically outward from the central conductive portion. The three branches function as the ports of the circulator and are positioned 120° apart from each other. The center conductor is sandwiched between a pair of ferrite discs. The outer surface of both the top ferrite disc and bottom ferrite disc are in contact with ground planes to thereby form a stripline configuration. A permanent magnet is disposed over each ground plane. The permanent magnets apply a predetermined magnetic field to bias the ferrite discs in a predictable manner. A steel pole member may be inserted between each ground plane/magnet pair. The function of the steel pole member is to ensure that the biasing magnetic field applied to the ferrites is substantially uniform.

Those of ordinary skill in the art will understand that the operating frequency of circulators and isolators is determined by a number of factors like disc diameter, permittivity of the ferrite disc, biasing field level and circuit shape. The operating frequency for a biased-above-resonance (A/R) circulator is generally limited to approximately 4 GHz, while the operation frequency for biased below resonance (B/R) circulators extends up to 30 GHz. Below resonance circulators typically operate over broader frequency range than above resonance circulators.

Some of the drawbacks associated with the various circulators/isolators described above relate to manufacturability and functionality issues. Circulators and Isolators are typically implemented as drop-in or connectorized units. Below resonance (B/R) microstrip circulators are typically comprised of ferrite substrates. The electric circuit is implemented by sputtering the circuit material onto the ferrite substrate. A microstrip circulator operating above 10 GHz must be biased by a strong magnet that is typically comprised of a metallic alloy. The magnet should be aligned and placed precisely over the central conductive portion to prevent the RF field from being disturbed by the presence of a metal object disposed over the microstrip lines. Subsequently, the magnet is bonded to the ferrite surface using relatively precise bonding techniques. Accordingly, this approach is characterized by drawbacks that create significant challenges in a production environment. The other challenge associated with this design relates to the connection of the microstrip circulator with external circuitry. The aforementioned connection is usually accomplished using wire bonding techniques. One issue related to wire bonding techniques relates to discontinuities in the 50 Ohm transmission line impedance that are prone to the excitation of unwanted reflections in the transmission path. Moreover, below resonance micro-strip devices require manual labor both to mount them into an assembly and to provide the necessary RF connections.

What is needed is a surface mountable design that is amenable to automated pick and place manufacturing processes that substantially eliminate or reduce labor-intensive assembly.

SUMMARY OF THE INVENTION

The present invention addresses the needs described above by providing a surface mountable design that can take advantage of automated pick and place manufacturing processes that substantially eliminates or reduces labor-intensive assembly.

One aspect of the present invention is directed to a circulator/isolator device that includes an electric circuit having predetermined electrical characteristics. The electric circuit includes at least one conductor disposed on at least one side of a first dielectric substrate. The at least one conductor includes at least one first transmission line, at least one second transmission line and at least one third transmission line that form a transmission line junction at a substantially central region on the at least one side of the first dielectric substrate. The at least one first transmission line includes a first electric circuit port disposed at a first edge of the first dielectric substrate. The at least one second transmission line includes a second electric circuit port disposed at a second edge of the first dielectric substrate. The at least one third transmission line includes a third electric circuit port disposed at a third edge of the first dielectric substrate. At least one second dielectric substrate is disposed adjacent the first dielectric substrate. The at least one second dielectric substrate includes an opening formed in a substantially central region of the at least one second dielectric substrate. The opening is aligned in a predetermined position relative to the transmission line junction formed at the substantially central region of the first dielectric substrate. A ferrite element is disposed in the opening of the at least one second dielectric substrate. The ferrite element is biased below ferromagnetic resonance in the presence of a biasing magnetic field and abuts a predetermined portion of the electric circuit. At least one third dielectric substrate is disposed adjacent the at least one second dielectric substrate. The at least one third dielectric layer includes an interior ground plane formed on an interior major surface of the at least one third dielectric substrate and disposed adjacent the at least one second dielectric substrate and an exterior ground plane formed on an exterior major surface of the at least one third dielectric substrate. The at least one third dielectric substrate includes a first-third dielectric port disposed at a first edge of the third dielectric substrate and coupled to the first electric circuit port, a second-third dielectric port disposed at a second edge of the third dielectric substrate and coupled to the second electric circuit port, and a third-third dielectric port disposed at a third edge of the third dielectric substrate and coupled to the third electric circuit port. The electric circuit, the at least one second dielectric substrate having the ferrite element, and the at least one third dielectric substrate are laminated together to form a surface mountable multi-layer assembly. The surface mountable multi-layer assembly is further characterized by a non-metallic magnetic circuit return path.

In another aspect, the present invention is directed to a method for making at least one surface mountable circulator/isolator device. The method includes disposing at least one conductor on at least one side of a first dielectric substrate to form an electric circuit having predetermined electrical characteristics. The at least one conductor includes at least one first transmission line, at least one second transmission line and at least one third transmission line that form a transmission line junction at a substantially central region on the at least one side of the first dielectric substrate. The at least one first transmission line including a first electric circuit port disposed at a first edge of the first dielectric substrate, the at least one second transmission line including a second electric circuit port disposed at a second edge of the first dielectric substrate, the at least one third transmission line including a third electric circuit port disposed at a third edge of the first dielectric substrate. The method also includes providing at least one second dielectric substrate. The method further includes forming an opening in a substantially central region of the at least one second dielectric substrate. The opening is formed such that it is aligned in a predetermined position relative to the transmission line junction formed at the substantially central region of the first dielectric substrate. The method further includes disposing the at least one second dielectric substrate adjacent the first dielectric substrate. The method further includes disposing a ferrite element in the opening of the at least one second dielectric substrate. The ferrite element is biased below ferromagnetic resonance in the presence of a biasing magnetic field. The ferrite element abuts a predetermined portion of the electric circuit. The method further includes disposing at least one third dielectric substrate adjacent the at least one second dielectric substrate. The at least one third dielectric layer includes an interior ground plane formed on an interior major surface of the at least one third dielectric substrate and disposed adjacent the at least one second dielectric substrate and an exterior ground plane formed on an exterior major surface of the at least one third dielectric substrate. The at least one third dielectric substrate includes a first-third dielectric port disposed at a first edge of the third dielectric substrate and coupled to the first electric circuit port, a second-third dielectric port disposed at a second edge of the third dielectric substrate and coupled to the second electric circuit port, and a third-third dielectric port disposed at a third edge of the third dielectric substrate and coupled to the third electric circuit port. The method further includes laminating the first dielectric substrate, the at least one second dielectric substrate having the ferrite element disposed in the opening, and the at least one third dielectric substrate to form at least one surface mountable multi-layer assembly. The at least one surface mountable multi-layer assembly is further characterized by a non-metallic magnetic circuit return path.

In yet another aspect, the present invention is directed to a method for making an RF assembly. The method includes the steps of providing a circulator/isolator device that includes an electric circuit having predetermined electrical characteristics. The electric circuit includes at least one conductor disposed on at least one side of a first dielectric substrate. The at least one conductor includes at least one first transmission line, at least one second transmission line and at least one third transmission line that form a transmission line junction at a substantially central region on the at least one side of the first dielectric substrate. The at least one first transmission line includes a first electric circuit port disposed at a first edge of the first dielectric substrate. The at least one second transmission line includes a second electric circuit port disposed at a second edge of the first dielectric substrate. The at least one third transmission line includes a third electric circuit port disposed at a third edge of the first dielectric substrate. At least one second dielectric substrate is disposed adjacent the first dielectric substrate. The at least one second dielectric substrate includes an opening formed in a substantially central region of the at least one second dielectric substrate. The opening is aligned in a predetermined position relative to the transmission line junction formed at the substantially central region of the first dielectric substrate. A ferrite element is disposed in the opening of the at least one second dielectric substrate. The ferrite element is biased below ferromagnetic resonance in the presence of a biasing magnetic field and abuts a predetermined portion of the electric circuit. At least one third dielectric substrate is disposed adjacent the at least one second dielectric substrate. The at least one third dielectric layer includes an interior ground plane formed on an interior major surface of the at least one third dielectric substrate and disposed adjacent the at least one second dielectric substrate and an exterior ground plane formed on an exterior major surface of the at least one third dielectric substrate. The at least one third dielectric substrate includes a first-third dielectric port disposed at a first edge of the third dielectric substrate and coupled to the first electric circuit port, a second-third dielectric port disposed at a second edge of the third dielectric substrate and coupled to the second electric circuit port, and a third-third dielectric port disposed at a third edge of the third dielectric substrate and coupled to the third electric circuit port. The electric circuit, the at least one second dielectric substrate having the ferrite element, and the at least one third dielectric substrate are laminated together to form a surface mountable multi-layer assembly. The surface mountable multi-layer assembly is further characterized by a non-metallic magnetic circuit return path. The method for making the RF assembly further includes providing an RF assembly substrate, the RF assembly substrate including at least one printed circuit formed thereon. The method for making the RF assembly further includes disposing a solder paste on the RF assembly substrate in accordance with the at least one printed circuit. The method for making the RF assembly further includes positioning the surface mountable multi-layer assembly at a predetermined position on the RF assembly substrate using an automated process. The solder paste is reflowed such that portions of the surface mountable multi-layer assembly are electrically and mechanically bonded to predetermined portions of the at least one printed circuit.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description are merely exemplary of the invention, and are intended to provide an overview or framework for understanding the nature and character of the invention as it is claimed. The accompanying drawings are included to provide a further understanding of the invention, and are incorporated in and constitute a part of this specification. The drawings illustrate various embodiments of the invention, and together with the description serve to explain the principles and operation of the invention.

DETAILED DESCRIPTION

Figure 1:
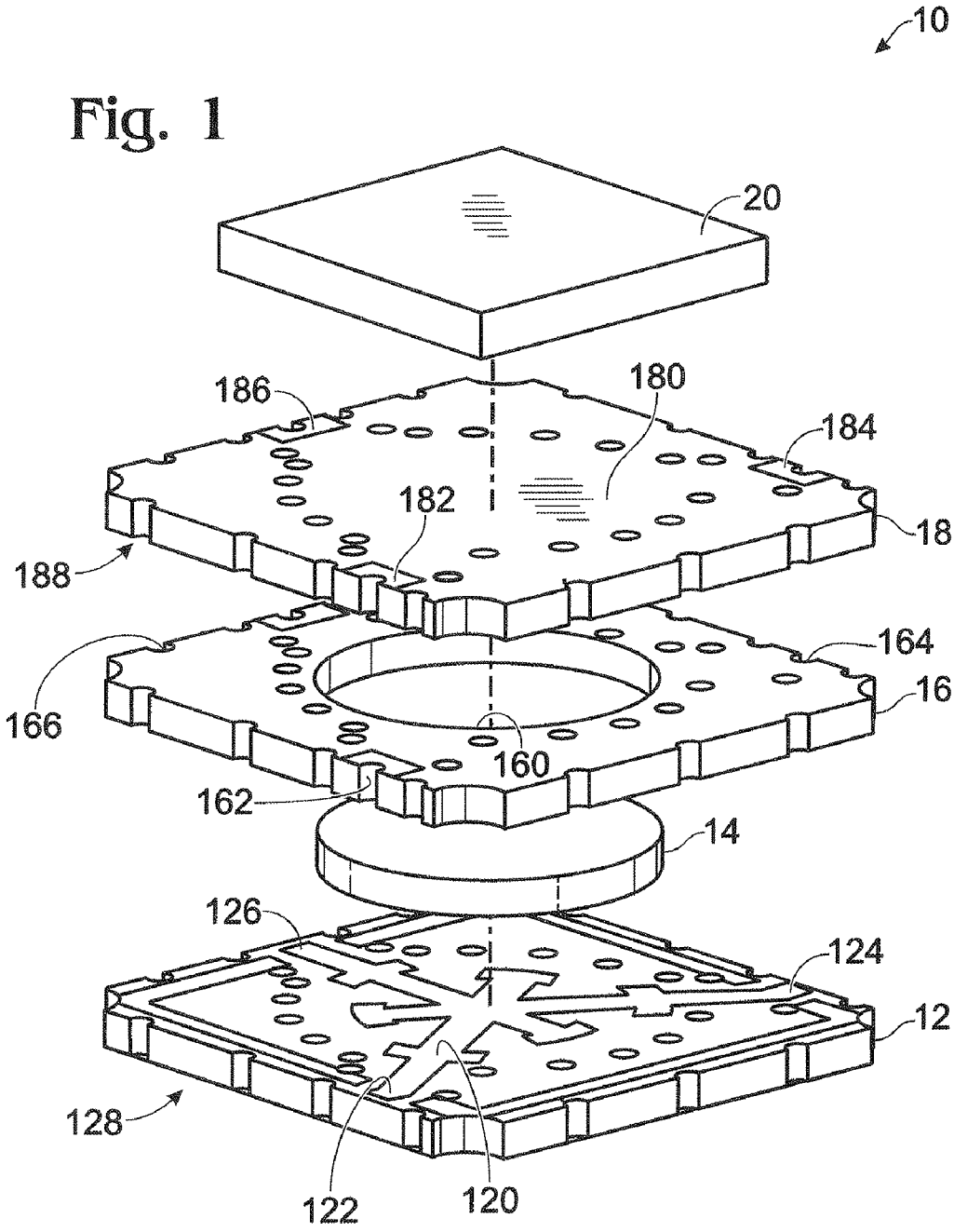
FIG. 1 is an exploded view of a surface mount circulator in accordance with one embodiment of the present invention.

Reference will now be made in detail to the present exemplary embodiments of the invention, examples of which are illustrated in the accompanying drawings. Wherever possible, the same reference numbers will be used throughout the drawings to refer to the same or like parts. An exemplary embodiment of the circulator/isolator of the present invention is shown in FIG. 1, and is designated generally throughout by reference numeral 10.

As embodied herein and depicted in FIG. 1, an exploded view of an asymmetric-stripline surface mount circulator device 10 in accordance with one embodiment of the present invention is disclosed. Device 10 includes a bottom dielectric layer 12 that includes an electric circuit 120 formed thereon. The electric circuit 120 includes three transmission lines (122, 124, 126) that extend outwardly from a central junction. Surface 128 is disposed on the side of dielectric layer 12 opposite the electric circuit layer. Surface 128 may include a ground plane formed of a metallic material (e.g., a copper foil material).

The dielectric layer 12 may be fabricated using a suitable non-ferrous dielectric material configured to support the electric circuit trace 120. Accordingly, the dielectric layer 12 may be formed using dielectric materials suitable for printed circuit boards (PCBs). As such, the dielectric layer 12 may be fabricated using suitable materials such as polytetrafluoroethylene (PTFE), for example. The present invention, however, should not be construed as being limited to PTFE. The dielectric layer 12 may also be fabricated using any suitable materials such as combinations of PTFE and woven glass fibers, PTFE and random micro fiber glass, ceramic, etc. The electric circuit 122 may be formed on one side of the dielectric layer 12 using standard PCB manufacturing techniques, such as physical vapor deposition (PVD), chemical vapor deposition (CVD), etc. In one embodiment of the present invention, for example, the dielectric layer 12 is implemented using commercially available ROGERS RO-3003 board.

The electric circuit 120 is implemented using any suitable conductive material, such as gold (Au), silver (Ag), copper (Cu), aluminum (Al), titanium (Ti), etc. Initially, the material is deposited on the surface of dielectric layer 12. A pattern of the electric circuit is transferred to the surface of the plated dielectric using photolithographic techniques. Subsequently, the conductive material that is exposed during the photolithographic imaging procedure is removed from the layer 12 such that the electric circuit 120 remains. Thus, the electric circuit 120 is formed as a circuit trace that includes no discontinuities or irregularities.

Figure 2:
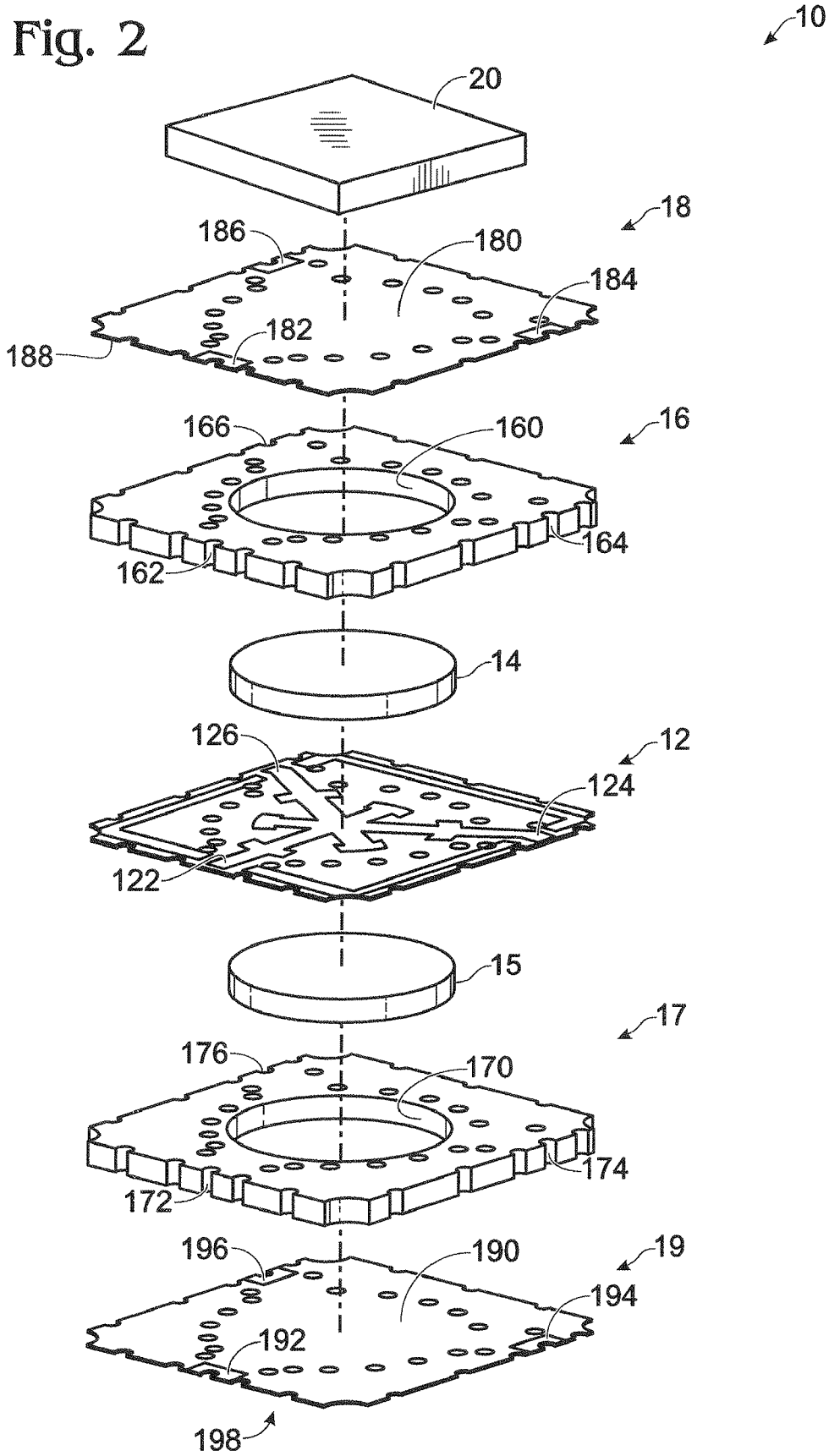
FIG. 2 is an exploded view of a surface mount circulator in accordance with another embodiment of the present invention.

Referring back to FIG. 1, an interior dielectric layer 16 is disposed over the bottom dielectric layer 12. The interior layer 16 includes a precisely formed opening 160 configured to accommodate and align a ferrite element 14 at a precise location over the electric circuit 120. The ferrite element 14 is shown in FIGS. 1 and 2 as a disk shaped element, but the present invention should not be construed as being limited to any particular geometric shape. Dielectric layer 16 also includes metalized vias 162, 164, and 166, respectively, formed along the edges of the interior layer 16.

A top dielectric layer 18 is disposed over the interior layer 16. The top dielectric layer 18 includes a ground plane 180

(e.g., a copper foil material) formed on most of the exposed surface thereof. The top layer 18 also provides an interior ground-plane 188 that is adjacent to, and in contact with, the ferrite disk 14. The upper ground plane 180 is connected to the lower ground plane 188 by way of metalized vias formed in the dielectric layer 18. A number of the vias connecting the top and the bottom ground plane may be used to suppress resonant modes.

The exposed surface of dielectric layer 18 also accommodates castellated signal through holes. For example, the dielectric layer 18 includes three exterior RF ports (182, 184, 186) formed along exterior edges of layer 18. The exterior RF ports 182, 184, 186 are connected to electric circuit ports 122, 124, and 126, respectively, by way of metalized vias 162, 164, and 166, respectively, formed along the edge of the interior layer 16.

Finally, a permanent magnet 20 may be bonded to the upper surface of the top layer 18 to provide the necessary magnetic biasing field to the ferrite element. In other embodiments, the magnetic bias may be provided by an external magnet, a solenoid, or by way of other such biasing means.

Again, the dielectric layers 12, 14, 16 and 18 may be formed using a suitable material including any suitable composite PTFE board. As implied above, in one embodiment of the present invention, the dielectric layers 12, 14, and 16 may be implemented using composite polytetrafluoroethylene (PTFE) materials. In one embodiment, the dielectric substrates may be implemented using commercially available ROGERS boards (e.g., RO-3003). The dielectric constant of a composite PTFE board such as the RO-3003 is approximately equal to 3.0. Depending on its function within the laminated multi-layer assembly, a PTFE board may include a copper layer (e.g., 0.5 ounce) disposed over the PTFE dielectric layer. Of course, the copper layer may function as a ground plane. The multi-layer PTFE structure is bonded to create a multi-layer laminate structure. In another embodiment of the present invention, the dielectric layers are fabricated using a ceramic material such as LTCC. The electric circuit 120 may also be formed by a screen printing process. The ground planes may also be printed or etched upon the LTCC layers using any suitable circuit trace process.

In general, the circulator depicted in FIG. 1, the asymmetric-stripline device 10 may be fabricated with a minimum of three dielectric layers. Although only one part is shown in FIG. 1 for clarity of illustration, in production, a 12 inch by 18 inch stack-up panel, for example, may be laminated together such that the ferrite elements become an embedded and integral part of each device in the panel. Of course, those of ordinary skill in the art will appreciate that the panel may be of any suitable size and the present invention should not be construed as being limited to 12 inch by 18 inch panels. Moreover, any suitable process for bonding the layers (12, 14, 16, 18) together may be employed. In a typical production process an entire panel will be stacked, populated with ferrite disks and laminated such that the ferrite disks are embedded within the panel. Individual parts are obtained afterwards by a process referred to herein as singulation. Subsequently, the magnet 20 is bonded to the exterior of the part in the manner depicted in FIG. 1. Finally, each part 10 is magnetically tuned and tested.

In an alternate embodiment of the present invention, the permanent magnet 20 is not part of the assembly of either FIG. 1 or FIG. 2. In this embodiment, the magnet may be replaced by any suitable biasing element provided by the end application. For example, the asymmetric-stripline surface mount device 10 may be employed in an RF assembly that includes a solenoid, a magnet or some other suitable biasing means that provides the functionality provided by magnet 20.

The ferrite junctions depicted herein are biased below ferromagnetic resonance and primarily utilized in a frequency range having a lower bound of approximately 2 GHz. The device may be employed in applications up to about 30 GHz. The ferrite material is saturated in the presence of the biasing magnetic field. The biasing magnet provides the necessary static magnetic field inside the ferrite element(s). The flux lines are closed through air and no additional housing structures are necessary. In order to improve the magnetic shielding of the device and/or to better utilize the permanent magnet, ferromagnetic return path structures may be employed.

As embodied herein and depicted in FIG. 2, an exploded view of a stripline surface mount circulator device 10 in accordance with another embodiment of the present invention is disclosed. In the stripline device 10, dielectric layer 12 is disposed in the middle of the device 10. As before, the various layers (14, 16, 18) are stacked above middle layer 12. In this embodiment however, layers (15, 17, 19) are disposed underneath the middle layer 12. The bottom layers (15, 17, 19) may be viewed as the mirror image of the upper layers (14, 16, 18).

The middle dielectric layer 12 again includes an electric circuit 120 formed thereon. The electric circuit 120 includes three transmission lines (122, 124, 126) that extend outwardly from a central junction. Surface 128 is disposed on the side of dielectric layer 12 opposite the electric circuit layer. In this embodiment a second circuit trace 120' (not shown) conforming to the electric circuit 120 is disposed on the undersurface 128. The upper and lower circuit traces (120, 120') are connected together using metalized vias formed in the interior of the dielectric layer 12. The use of the two ferrites provides an increase in performance relative to bandwidth, insertion loss, and isolation.

Like the first embodiment, the dielectric layer 12 may be fabricated using a suitable non-ferrous dielectric material configured to support the electric circuit traces 120, 120'. Accordingly, the dielectric layer 12 may be formed using dielectric materials suitable for printed circuit boards (PCBs). As such, the dielectric layer 12 may be fabricated using suitable materials such as polytetrafluoroethylene (PTFE), for example.

The present invention, however, should not be construed as being limited to PTFE. The dielectric layer 12 may also be fabricated using any suitable materials such as combinations of PTFE and woven glass fibers, PTFE and random micro fiber glass, ceramic, etc. The electric circuit 122 may be formed on one side of the dielectric layer 12 using standard PCB manufacturing techniques, such as physical vapor deposition (PVD), chemical vapor deposition (CVD), etc. In one embodiment, the dielectric substrates may be implemented using commercially available ROGERS boards (e.g., RO-3003). The dielectric constant of a composite PTFE board such as the RO-3003 is approximately equal to 3.0. Those of ordinary skill in the art will understand, however, that other materials may be employed with various dielectric properties. For example, the dielectric constant may be altered based on impedance matching characteristics. Thus, the dielectric constant may be 3.0, 6.0, 10.0 or higher. Depending on its function within the laminated multi-layer assembly, a PTFE board may include a copper layer (e.g., 0.5 ounce) disposed over the PTFE dielectric layer. Of course, the copper layer may function as a ground plane. The multi-layer PTFE structure is bonded to create a multi-layer laminate stripline structure. The electric circuit traces (120, 120') may be comprised of any suitable conductive material such as gold (Au), silver (Ag), copper (Cu), aluminum (Al), titanium (Ti), etc. and formed using any suitable manufacturing techniques.

In the symmetric stripline embodiment depicted in FIG. 2, an upper interior dielectric layer 16 is disposed over the bottom dielectric layer 12 and a lower interior dielectric layer 17 is disposed under the middle dielectric layer 12 such that middle layer 12 is sandwiched between upper interior layer 16 and lower interior layer 17. The interior layer 16 includes a precisely formed opening 160 configured to accommodate and align a ferrite disk 14 at a precise location over the electric circuit 120. In like fashion, the lower interior layer 17 also includes a precisely formed opening 170 configured to accommodate and align a ferrite disk 15 at a precise location under the electric circuit traces 120, 120'. Dielectric layer 16 includes metalized vias 162, 164, and 166, respectively, formed along the edges of the interior layer 16. Dielectric layer 17 also includes metalized vias 172, 174, and 176, respectively, formed along the edges of the lower interior layer 17.

An upper dielectric layer 18 is disposed over the interior layer 16 whereas a lower dielectric layer 19 is disposed under the interior layer 17. The top dielectric layer 18 includes a ground plane 180 formed on most of the exposed surface thereof. The top layer 18 also provides an interior ground-plane 188 that is adjacent to, and in contact with, the ferrite disk 14. The upper ground plane 180 is connected to the lower ground plane 188 by way of metalized vias formed in the dielectric layer 18. A number of the vias connecting the top and the bottom ground plane may be used to suppress resonant modes. Similarly, the bottom dielectric layer 19 includes a ground plane 198 formed on a majority of the exposed surface thereof. The lower dielectric layer 18 also provides an interior ground-plane 190 that is adjacent to, and in contact with, the ferrite disk 15. The upper ground plane 190 is connected to the lower ground plane 198 by way of metalized vias formed in the dielectric layer 19.

The dielectric layer 18 includes three exterior RF ports (182, 184, 186) formed along exterior edges of layer 18. The exterior RF ports 182, 184, 186 are connected to metalized vias 162, 164, and 166, respectively, formed along the edge of the interior layer 16. The vias (162, 164, 166) are connected to the electric circuit ports 122, 124, and 126, respectively. The electric circuit ports 122, 124, and 126 are also connected to the metalized vias 172, 174, and 176, respectively, formed along the edge of the interior layer 17. The undersurface of dielectric layer 19 includes three exterior RF ports (192, 194, 196) formed along exterior edges of layer 19. The exterior RF ports 192, 194, 196 are connected to electric circuit ports 122, 124, and 126, respectively, by way of metalized vias 172, 174, and 176, respectively, formed along the edge of the interior layer 17. Thus, there is complete electrical connectivity from top to bottom in the stripline device of FIG. 2. Finally, a permanent magnet 20 is bonded to the upper surface of the top layer 18 to provide the necessary magnetic biasing field to the ferrite element.

Like the previous embodiment, the dielectric layers 12-18 may be formed using a suitable material including any suitable composite PTFE board. As implied above, in one embodiment of the present invention, the dielectric layers 12, 14, and 16 may be implemented using composite PTFE boards such as commercially available ROGERS RO-3003 boards. In another embodiment of the present invention, the dielectric layers are fabricated using a ceramic material such as LTCC. The electric circuit 120 may be formed by a screen printing process. The ground planes may also be printed or etched upon the LTCC layers using any suitable circuit trace process.

In general, the circulator depicted in FIG. 2, may be fabricated with a minimum of five dielectric layers. Although only one part is shown in FIG. 2 for clarity of illustration, in production, a 12 inch by 18 inch stack-up panel is laminated together such that the ferrite elements become an embedded and integral part of each device in the panel. Any suitable process for bonding the layers (12-19) together may be employed. In a typical production process an entire panel will be stacked, populated with ferrite disks and laminated such that the ferrite disks are embedded within the panel. Individual parts are obtained afterwards by a process referred to herein as singulation. Afterwards, the magnet 20 is bonded to the exterior of the part in the manner depicted in FIG. 2. Again, each part 10 is magnetically tuned and tested.

As in the asymmetric stripline embodiment, the ferrite junctions depicted herein are biased below ferromagnetic resonance and primarily utilized in a frequency range having a lower bound of approximately 2 GHz. The device may be employed in applications up to about 30 GHz. The ferrite material is saturated in the presence of the biasing magnetic field. The biasing magnet provides the necessary static magnetic field inside the ferrite element(s). The flux lines are closed through air and no additional housing structures are necessary. In order to improve the magnetic shielding of the device and/or to better utilize the permanent magnet, ferromagnetic return path structures may be employed.

Figure 3:
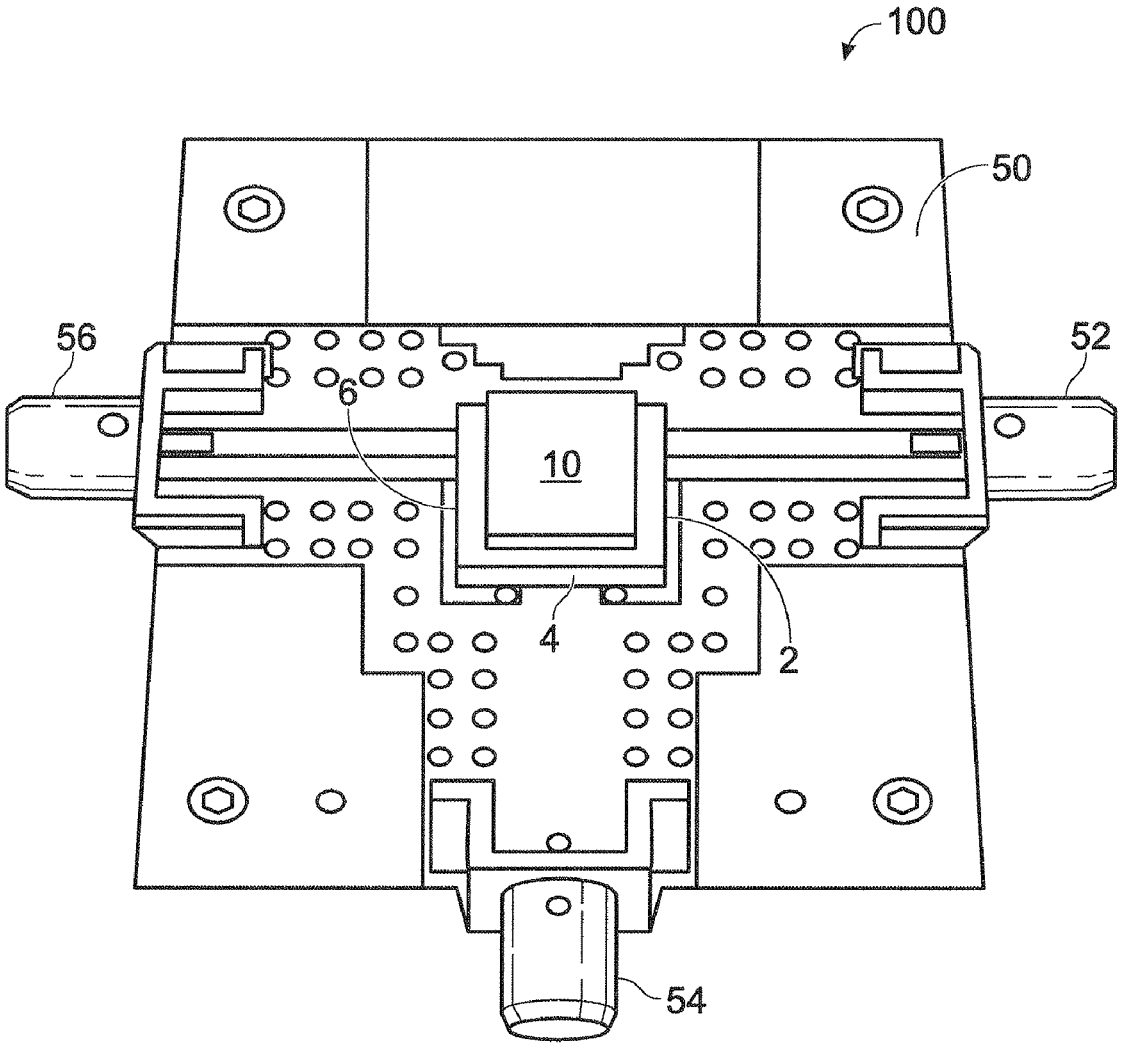
FIG. 3 is a perspective view of the circulator depicted in FIG. 1 or FIG. 2.

Referring to an example application depicted in FIG. 3, a perspective view of the circulator/isolator device 10 depicted in either FIG. 1 or FIG. 2 is shown. Device 10 may be surface mounted on printed circuit board 50 such that the device ports 2, 4, 6 are connected to the RF connectors 52, 54, and 56, respectively. The device 10 depicted in FIG. 2 has a thickness of approximately 4 mm and is about 10 $mm^2$. Those skilled in the art will understand that the devices 10 of the present invention may be mounted on any suitable printed circuit board using standard pick-and-place manufacturing techniques. The manufacturing process results in a laminated rectangular panel having a two-dimensional array of devices disposed thereon. The laminated panel is fabricated by sandwiching three to five dielectric layers. The electric circuit is formed using a very thin dielectric layer. The electric circuits are typically formed by using standard photolithography techniques, i.e., the array of stripline devices are imaged onto the copper surfaces and subsequently etched, removing any excess copper material. This process is quite accurate and in the stripline embodiment positions the coupled transmission lines on either side of the thin dielectric layer 12 within very high tolerances. Device performance parameters such as amplitude balance, phase balance, insertion loss, etc. are very predictable. The process is very efficient, very large panels may be produced using very high levels of automation. Thus, the method is very conducive to low cost, high volume manufacturing.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening.

The recitation of ranges of values herein are merely intended to serve as a shorthand method of referring individually to each separate value falling within the range, unless otherwise indicated herein, and each separate value is incorporated into the specification as if it were individually recited herein.

All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not impose a limitation on the scope of the invention unless otherwise claimed.

No language in the specification should be construed as indicating any non-claimed element as essential to the practice of the invention.

It will be apparent to those skilled in the art that various modifications and variations can be made to the present invention without departing from the spirit and scope of the invention. There is no intention to limit the invention to the specific form or forms disclosed, but on the contrary, the intention is to cover all modifications, alternative constructions, and equivalents falling within the spirit and scope of the invention, as defined in the appended claims. Thus, it is intended that the present invention cover the modifications and variations of this invention provided they come within the scope of the appended claims and their equivalents.

What is claimed is:

1. A circulator/isolator device comprising:

an electric circuit having predetermined electrical characteristics, the electric circuit including at least one conductor disposed on at least one side of a first dielectric substrate, the at least one conductor including at least one first transmission line, at least one second transmission line and at least one third transmission line that form a transmission line junction at a substantially central region on the at least one side of the first dielectric substrate, the at least one first transmission line including a first electric circuit port disposed at a first edge of the first dielectric substrate, the at least one second transmission line including a second electric circuit port disposed at a second edge of the first dielectric substrate, the at least one third transmission line including a third electric circuit port disposed at a third edge of the first dielectric substrate;

at least one second dielectric substrate disposed adjacent the first dielectric substrate, the at least one second dielectric substrate including an opening formed in a substantially central region of the at least one second dielectric substrate, the opening being aligned in a predetermined position relative to the transmission line junction formed at the substantially central region of the first dielectric substrate;

a ferrite element disposed in the opening of the at least one second dielectric substrate, the ferrite element being biased below ferromagnetic resonance in the presence of a biasing magnetic field, the ferrite element abutting a predetermined portion of the electric circuit;

at least one third dielectric substrate disposed adjacent the at least one second dielectric substrate, the at least one third dielectric layer including an interior ground plane formed on an interior major surface of the at least one third dielectric substrate and disposed adjacent the at least one second dielectric substrate and an exterior ground plane formed on an exterior major surface of the at least one third dielectric substrate, the at least one third dielectric substrate including a first-third dielectric port disposed at a first edge of the third dielectric substrate and coupled to the first electric circuit port, a second-third dielectric port disposed at a second edge of the third dielectric substrate and coupled to the second electric circuit port, and a third-third dielectric port disposed at a third edge of the third dielectric substrate and coupled to the third electric circuit port, the electric circuit, the at least one second dielectric substrate having the ferrite element, and the at least one third dielectric substrate being laminated together to form a surface mountable multi-layer assembly, the surface mountable multi-layer assembly being further characterized by a non-metallic magnetic circuit return path.

2. The device of claim 1, wherein the multi-layer assembly is configured as an asymmetric strip-line assembly.

3. The device of claim 1, wherein the multi-layer assembly is configured as a symmetric strip-line assembly.

4. The device of claim 1, wherein the at least one conductor is formed on the at least one side of the first dielectric substrate by a photolithographic process.

5. The device of claim 1, wherein the at least one conductor is disposed on the at least one side of the first dielectric substrate by a screen printing process.

6. The device of claim 1, wherein the electric circuit conductor is formed on a first side of the first dielectric substrate and a ground plane is formed on a second side of the first dielectric substrate.

7. The device of claim 1, wherein the first dielectric substrate, the at least one of second dielectric substrate and the at least one third dielectric substrate are comprised of a composite polytetrafluoroethylene (PTFE) substrate.

8. The device of claim 1, wherein the first dielectric substrate, the at least one of second dielectric substrate and the at least one third dielectric substrate are comprised of a material selected from a group of materials that includes a polymer material, composite PTFE material, a PTFE and woven glass fiber material, a PTFE and random micro fiber glass material, or an LTCC ceramic material.

9. The device of claim 1, wherein a permanent magnet bonded to the surface mountable multi-layer assembly adjacent the exterior ground plane, the permanent magnet being tuned to generate the biasing magnetic field in accordance with predetermined performance parameters.

10. The device of claim 1, wherein the at least one conductor is comprised of a conductive material selected from a group of conductive materials that includes gold (Au), silver (Ag), copper (Cu), aluminum (Al), or titanium (Ti).

11. The method of claim 10, further comprising the step of tuning the permanent magnet to provide the biasing magnetic field in accordance with predetermined performance parameters of the circulator device.

12. The device of claim 1, wherein the at least one conductor includes a first electric circuit conductor disposed on a first major surface of the first dielectric substrate and a second electric circuit conductor disposed on a second major surface of the first dielectric substrate, the first electric circuit conductor and the second electric circuit conductor being parallel one with the other and having a substantially identical form factor, the first electric circuit conductor and the second electric circuit conductor being interconnected by a plurality of vias extending through the first dielectric substrate.

13. The device of claim 12, wherein the multi-layer assembly is configured as a symmetric strip-line assembly.

14. The device of claim 1 further comprising a magnetic biasing element coupled to the surface mountable multi-layer assembly, the magnetic biasing element being configured to generate the biasing magnetic field.

15. The device of claim 14, wherein the magnetic biasing element is a solenoid element disposed proximate the surface mountable multi-layer assembly.

16. The device of claim 14, wherein the magnetic biasing element is a permanent magnet coupled to the surface mountable multi-layer assembly.

17. The device of claim 16, wherein the permanent magnet is bonded to the at least one third dielectric substrate.

18. The device of claim 1, wherein the first dielectric substrate includes a first electric circuit conductor disposed on a first major surface of the first dielectric substrate and a second electric circuit conductor disposed on a second major surface of the first dielectric substrate, the first electric circuit conductor and the second electric circuit conductor being parallel one with the other and having a substantially identical form factor, and wherein the at least one second dielectric substrate includes a first-second dielectric substrate disposed adjacent the first major surface of the first dielectric substrate and a second-second dielectric substrate disposed adjacent the second major surface of the first dielectric substrate, and wherein the ferrite disk includes a first ferrite disk abutting a predetermined portion of the first electric circuit conductor and a second ferrite disk abutting a predetermined portion of the second electric circuit conductor, and wherein the at least one third dielectric substrate includes a first-third dielectric substrate disposed adjacent the first-second dielectric substrate and a second-third dielectric substrate disposed adjacent the second-second dielectric substrate.

19. The device of claim 18, wherein the multi-layer assembly is configured as a symmetric strip-line assembly.

20. The device of claim 18, wherein the single permanent magnet is bonded to the multi-layer assembly adjacent the exterior ground plane of the first-third dielectric substrate.

21. A method for making at least one surface mountable circulator/isolator device, the method comprising:

disposing at least one conductor on at least one side of a first dielectric substrate to form an electric circuit having predetermined electrical characteristics, the at least one conductor including at least one first transmission line, at least one second transmission line and at least one third transmission line that form a transmission line junction at a substantially central region on the at least one side of the first dielectric substrate, the at least one first transmission line including a first electric circuit port disposed at a first edge of the first dielectric substrate, the at least one second transmission line including a second electric circuit port disposed at a second edge of the first dielectric substrate, the at least one third transmission line including a third electric circuit port disposed at a third edge of the first dielectric substrate;

providing at least one second dielectric substrate;

forming an opening in a substantially central region of the at least one second dielectric substrate, the opening being formed such that it is aligned in a predetermined position relative to the transmission line junction formed at the substantially central region of the first dielectric substrate;

disposing the at least one second dielectric substrate adjacent the first dielectric substrate;

disposing a ferrite element in the opening of the at least one second dielectric substrate, the ferrite element being biased below ferromagnetic resonance in the presence of a biasing magnetic field, the ferrite element abutting a predetermined portion of the electric circuit;

disposing at least one third dielectric substrate adjacent the at least one second dielectric substrate, the at least one third dielectric layer including an interior ground plane formed on an interior major surface of the at least one third dielectric substrate and disposed adjacent the at least one second dielectric substrate and an exterior ground plane formed on an exterior major surface of the at least one third dielectric substrate, the at least one third dielectric substrate including a first-third dielectric port disposed at a first edge of the third dielectric substrate and coupled to the first electric circuit port, a second-third dielectric port disposed at a second edge of the third dielectric substrate and coupled to the second electric circuit port, and a third-third dielectric port disposed at a third edge of the third dielectric substrate and coupled to the third electric circuit port; and laminating the first dielectric substrate, the at least one second dielectric substrate having the ferrite element disposed in the opening, and the at least one third dielectric substrate to form at least one surface mountable multi-layer assembly, the at least one surface mountable multi-layer assembly being further characterized by a non-metallic magnetic circuit return path.

22. The method of claim 21, wherein the surface mountable assembly is configured as an asymmetric strip line assembly.

23. The method of claim 21, wherein the surface mountable assembly is configured as a symmetric strip line assembly.

24. The method of claim 21, wherein the step of disposing at least one conductor further comprises the step of disposing a first electric circuit conductor on a first major surface of the first dielectric substrate and disposing a second electric circuit conductor on a second major surface of the first dielectric substrate, the first electric circuit conductor and the second electric circuit conductor being parallel one with the other; and wherein the step of disposing the at least one second dielectric substrate includes disposing a first-second dielectric substrate adjacent the first major surface of the first dielectric substrate and disposing a second-second dielectric substrate adjacent the second major surface of the first dielectric substrate, the a ferrite element including a first ferrite element abutting a predetermined portion of the first electric circuit conductor and a second ferrite element abutting a predetermined portion of the second electric circuit conductor, and wherein the step of disposing the at least one third dielectric substrate includes disposing a first-third dielectric substrate adjacent the first-second dielectric substrate and disposing a second-third dielectric substrate adjacent the second-second dielectric substrate.

25. The method of claim 21, wherein the at least one surface mountable multi-layer assembly includes a plurality of surface mountable multi-layer assemblies disposed in a laminated multi-layer panel, the laminated multi-layer panel being diced to thereby singulate the plurality of surface mountable multi-layer assemblies.

26. The method of claim 21, further comprising the step of coupling a magnetic biasing element to the surface mountable multi-layer assembly, the magnetic biasing element being configured to generate the biasing magnetic field.

27. The device of claim 26, wherein the magnetic biasing element is a solenoid element disposed proximate the surface mountable multi-layer assembly.

28. The device of claim 26, wherein the magnetic biasing element is a permanent magnet coupled to the surface mountable multi-layer assembly.

29. The device of claim 28, wherein the permanent magnet is bonded to the at least one third dielectric substrate.

30. A method for making an RF assembly, the method comprising:

providing a circulator/isolator device that includes, an electric circuit having predetermined electrical characteristics, the electric circuit including at least one conductor disposed on at least one side of a first dielectric substrate, the at least one conductor including at least one first transmission line, at least one second transmission line and at least one third transmission line that form a transmission line junction at a substantially central region on the at least one side of the first dielectric substrate, the at least one first transmission line including a first electric circuit port disposed at a first edge of the first dielectric substrate, the at least one second transmission line including a second electric circuit port disposed at a second edge of the first dielectric substrate, the at least one third transmission line including a third electric circuit port disposed at a third edge of the first dielectric substrate, at least one second dielectric substrate disposed adjacent the first dielectric substrate, the at least one second dielectric substrate including an opening formed in a substantially central region of the at least one second dielectric substrate, the opening being aligned in a predetermined position relative to the transmission line junction formed at the substantially central region of the first dielectric substrate, a ferrite element disposed in the opening of the at least one second dielectric substrate, the ferrite element being biased below ferromagnetic resonance in the presence of a biasing magnetic field, the ferrite element abutting a predetermined portion of the electric circuit, at least one third dielectric substrate disposed adjacent the at least one second dielectric substrate, the at least one third dielectric layer including an interior ground plane formed on an interior major surface of the at least one third dielectric substrate and disposed adjacent the at least one second dielectric substrate and an exterior ground plane formed on an exterior major surface of the at least one third dielectric substrate, the at least one third dielectric substrate including a first-third dielectric port disposed at a first edge of the third dielectric substrate and coupled to the first electric circuit port, a second-third dielectric port disposed at a second edge of the third dielectric substrate and coupled to the second electric circuit port, and a third-third dielectric port disposed at a third edge of the third dielectric substrate and coupled to the third electric circuit port, the electric circuit, the at least one second dielectric substrate having the ferrite element, and the at least one third dielectric substrate being laminated together to form a surface mountable multi-layer assembly, the surface mountable multi-layer assembly being further characterized by a non-metallic magnetic circuit return path;

providing an RF assembly substrate, the RF assembly substrate including at least one printed circuit formed thereon;

disposing a solder paste on the RF assembly substrate in accordance with the at least one printed circuit;

positioning the surface mountable multi-layer assembly at a predetermined position on the RF assembly substrate using an automated process; and reflowing the solder paste such that portions of the surface mountable multi-layer assembly are electrically and mechanically bonded to predetermined portions of the at least one printed circuit.

31. The method of claim 30, wherein the surface mountable multi-layer assembly is configured as a symmetric strip-line assembly.

32. The method of claim 30, wherein the surface mountable multi-layer assembly is configured as an asymmetric strip-line assembly.

33. The method of claim 30, wherein the automated process employs a pick-and-place process.

34. The method of claim 30, wherein the step of providing a circulator/isolator device includes bonding a permanent magnet bonded to the surface mountable multi-layer assembly adjacent the exterior ground plane, the permanent magnet being tuned to provide the biasing magnetic field in accordance with predetermined performance parameters.

35. The method of claim 30, further comprising the step of coupling a magnetic biasing element to the surface mountable multi-layer assembly, the magnetic biasing element being configured to generate the biasing magnetic field.

36. The method of claim 35, wherein the magnetic biasing element is a solenoid element disposed proximate the surface mountable multi-layer assembly on the RF assembly substrate.

37. The method of claim 35, wherein the magnetic biasing element is a permanent magnet coupled to the surface mountable multi-layer assembly.

38. The method of claim 37, wherein the permanent magnet is bonded to the at least one third dielectric substrate.

* * * * *